US007407343B2

(12) United States Patent
van Halteren et al.

(10) Patent No.: US 7,407,343 B2
(45) Date of Patent: Aug. 5, 2008

(54) HYDRAULIC-FORCED RESONANCE-FREE VIBRATORY SHEET PILING DRIVING AND EXTRACTION MACHINE

(76) Inventors: Peter van Halteren, Eemdijk 129, 3754 NE. Eemdijk (NL); Jan van Coterlet, Piet Heinstraat 1, 3752 CW Bunschoten (NL)

( * ) Notice: Subject to any disclaimer, the term of this patent is extended or adjusted under 35 U.S.C. 154(b) by 0 days.

(21) Appl. No.: 11/025,621

(22) Filed: Dec. 28, 2004

(65) Prior Publication Data

US 2006/0140727 A1 Jun. 29, 2006

(51) Int. Cl.
*E02D 7/06* (2006.01)
*E02D 7/18* (2006.01)

(52) U.S. Cl. ..... 405/232; 405/274; 173/1; 173/49; 173/187

(58) Field of Classification Search ..... 405/273, 405/274; 173/1, 49, 184, 186, 187, 189
See application file for complete search history.

(56) References Cited

U.S. PATENT DOCUMENTS

| | | | | |
|---|---|---|---|---|
| 2,209,660 | A * | 7/1940 | Oka | 254/29 R |
| 3,888,317 | A * | 6/1975 | Walters | 173/193 |
| 3,889,482 | A | 6/1975 | Frederick | 173/49 X |
| 4,094,156 | A | 6/1978 | Dumont | 405/274 |
| 4,195,698 | A | 4/1980 | Nakagawasai | 173/44 |
| 4,557,630 | A | 12/1985 | Neil | 405/232 |
| 4,709,764 | A | 12/1987 | Gibbons | 173/45 |
| 5,568,997 | A | 10/1996 | Raunisto et al. | |
| 6,234,719 | B1 | 5/2001 | Roynestad | |
| 6,386,295 | B1 * | 5/2002 | Suver | 173/1 |
| 6,604,583 | B1 | 8/2003 | Van Randen | 173/49 |
| 2002/0139551 | A1 * | 10/2002 | Mewes | 173/114 |

OTHER PUBLICATIONS

PCT Notification of Transmittal of Search Report and Written Opinion, dated Sep. 1, 2006, along with Search Report and Written Opinion.

* cited by examiner

*Primary Examiner*—Tara L. Mayo
(74) *Attorney, Agent, or Firm*—Edwards Angell Palmer & Dodge LLP

(57) ABSTRACT

An apparatus and method for continuously preloading during installation and removal of steel sheet piles, steel pilings, and casing piles, with a telescoping, articulated boom having a free end for creating the downward driving force, a weighted base to provide support and stability for the boom, a connector at the free end of said boom to engage the piling, a modified resonance-free vibratory hammer, to allow for simultaneously vibrating the piling while applying to the piling the continuous downward or upward force.

12 Claims, 6 Drawing Sheets

HYDRAULIC-FORCED RESONANCE-FREE VIBRATORY SHEET PILING DRIVING AND EXTRACTION MACHINE

BACKGROUND OF THE INVENTION

1. Field of the Invention

This invention relates to a machine and method for driving sheet piling that uses an articulated boom for vertical, upward or downward force and a resonance-free vibratory hammer to rapidly install or remove sheet piles using continuous force.

2. Description of Related Art

Sheet piles are elongated, often corrugated, vertical metallic members driven into sand or other loose earth to act as sea walls or to hold back earthen embankments. Machines for driving vertical members, and particularly sheet piles, into the ground are well known in the prior art. U.S. Pat. No. 4,195,698, issued Jan. 20, 1978 to Nakagawasai, uses a base body to exert a pull-down force so that an earth auger applies a downward propelling force to an auger screw which is a member to be driven into the ground. The base body is brought down vertically by a chain to which it is mounted. The endless chain is connected around upper and lower sprockets of a leader that is driven. The base body comprises a rotary power portion having an output shaft to which the auger screw is connected and that is moved downward by the endless chain. A pile-holding portion at the lower part of said rotary power portion holds the pile as it is driven into the ground adjacent to the hole created by the auger screw. This invention does not incorporate any means of vibration to enhance the efficacy of its pile-driving ability.

U.S. Pat. No. 3,889,482, issued Jun. 17, 1975 to Frederick, describes a jet sheet and circular pile with water hammer assist wherein a supply of lubricant or preferably water is furnished to the sides of a section of piling to facilitate the driving of the piling into the ground through earthen strata. The use of water also creates a water hammer effect that acts synergistically with the vibratory driver by generating a shock wave with a pressure of 3,000 psi in approximately 1/400 of a second so that the pile is driven more easily into the ground. This invention relies on the water hammer effect and vibration to drive pilings into the ground.

In U.S. Pat. No. 4,709,764, issued Dec. 1, 1987 to Gibbons, the invention relates to a sheet pile supported driver wherein a sheet pile driver rides along a single wall of sheet piles already driven into the ground so that the pile driver moves progressively forward as it drives subsequent sheet -piles into the ground. Sheet pile driving is slow and cumbersome using this invention due to the roller and track assembly used to move it on top of the wall of sheet piles.

U.S. Pat. No. 4,094,156, issued Jun. 13, 1978 to Dumont, describes a method and apparatus for driving sheet piles into the ground in which a hole-drilling mechanism works beside the driving mechanism to create a cavity adjacent to the sheet pile as it is being driven into the ground so that earth that is displaced by the driven sheet pile can be received by said adjacent cavity thereby facilitating driving of the sheet pile. In this invention, the sheet piles are engaged with a framework upon which hydraulic pressing devices press downward, thereby driving the sheet piles into the ground.

U.S. Pat. No. 4,557,630, issued Dec. 10, 1985 to Neil, describes a vibratory clamping device for use with an excavator in supporting and placing sheet pilings when excavating in sand, running sand, and silt. This device provides a means for obviating damage caused to sheet piles while they are hammered into ground with water present therein, but does not include a means for driving the sheet piles into the ground.

The invention described in this particular patent is connected to the mounting for an excavator bucket.

U.S. Pat. No. 6,604,583, issued Aug. 12, 2003 to Van Randen, describes a device and method for driving an object, including sheet piles, into the ground using vibration. U.S. Pat. No. 4,625,811, issued Dec. 2, 1986 to Tuenkers, relates to a hydraulic vibratory pile driver, in which hydraulic motors are connected to and rotate shafts and weights thereby creating vibration that, along with the weight of the driver, causes the pile to sink into the ground. Both of these patents use vibration as their sole means for driving piles into the ground.

SUMMARY OF THE INVENTION

A machine and method for driving an elongated sheet piling that allows for automatic continuous force for preloading or extraction of the sheet piling during installation and removal.

The machine includes a large weighted base carrier that rests on the earth that includes a vertically supported boom that can be articulated using hydraulic force for creating vertical, upward or downward forces from the base carrier through the boom.

A resonance-free vibratory hammer, which operates in a frequency much greater than the resonant frequency of the earth into which the sheet piling is being driven, is attached at the free end of the boom. An articulated swivel connector at the free end of the boom connects the boom to the modified upper portion of the resonance-free vibratory hammer which itself is connected directly to the sheet piling.

The boom itself, which is attached at one end to the large weighted base carrier, provides elongated bi-directional, hydraulically-powered force through an internal, hydraulic, double-acting cylinder. The internal hydraulic cylinder can be variable-controlled under load for vertical, upward or downward force that acts on the resonance-free vibratory hammer, which is hinged and can move freely while connected to the boom. The resonance-free vibratory hammer can be, for example, one of the PVE BV line of VM vibratory hammers such as Model No. PVE23VMA. The boom can be operated at an angle from the base carrier ranging from 0 to 96 degrees.

Using the telescopic boom, sheet pilings of extreme length can be driven into the earth applying a continuous downward force from the boom on the sheet piling while using the resonance-free vibratory hammer to vibrate said sheet piling. Likewise, an upward force can be applied for retrieving or removing sheet piling from the ground forcefully.

While providing the force, either upward or downward, from the boom and simultaneously vibrating the sheet piling to drive the sheet piling into the soil or forcefully extracting the sheet piling from the ground, the present invention can greatly expedite installing or removing extreme lengths of sheet piling without creating resonance that may disturb or destroy other existing structures adjacent to the sheet piling operation.

The method of vibrating the driven sheet pile at the same time that continuous downward force is applied to said sheet pile facilitates installing the sheet pile. Because the machine and method permits continuous preloading of sheet piles, the efficiency of the sheet pile driving process is increased.

The sheet piling driver includes the large weighted base carrier resting on the ground that vertically anchors the boom for counterbalancing a large downward (or upward) hydraulically-harnessed force from the carrier through said boom to the sheet piling. The resonance-free vibratory hammer which operates well above 12 Hz ground resonance, such as, for example the PVE BV line of VM vibratory hammers, is connected by an articulated connector at the free end of the boom for connecting said boom to the sheet piling. Once the resonance-free vibratory hammer is connected to the sheet piling that is to be installed, a continuous downward (or upward) force from the boom is applied onto the sheet piling which is aligned perfectly for plumb insertion into the earth. At the same time, the sheet piling is vibrated to help drive it into the soil. Using the method of the present invention, the boom is automatically controlled during elongation and contraction of the boom so that the sheet piling is always plumb in three-dimensional planes with the earth. The special connector to the vibratory hammer is comprised of a swivel and a special universal joint that attaches to the free end of the boom. The sheet piling being installed is connected directly at one end to the vibratory hammer.

An object of this invention is to increase the efficiency and speed with which sheet piles can be installed.

Another object of this invention is to increase the downward and upward forces with which the sheet piles are driven into the ground, while using a resonance-free vibratory hammer.

Still another object of this invention is to expedite installing or removing extreme lengths of sheet piling without creating resonance that may disturb or destroy other existing structures adjacent to the sheet piling operation.

In accordance with these and other objects which will become apparent hereinafter, the instant invention will now be described with particular reference to the accompanying drawings.

DETAILED DESCRIPTION

Figure 1A:
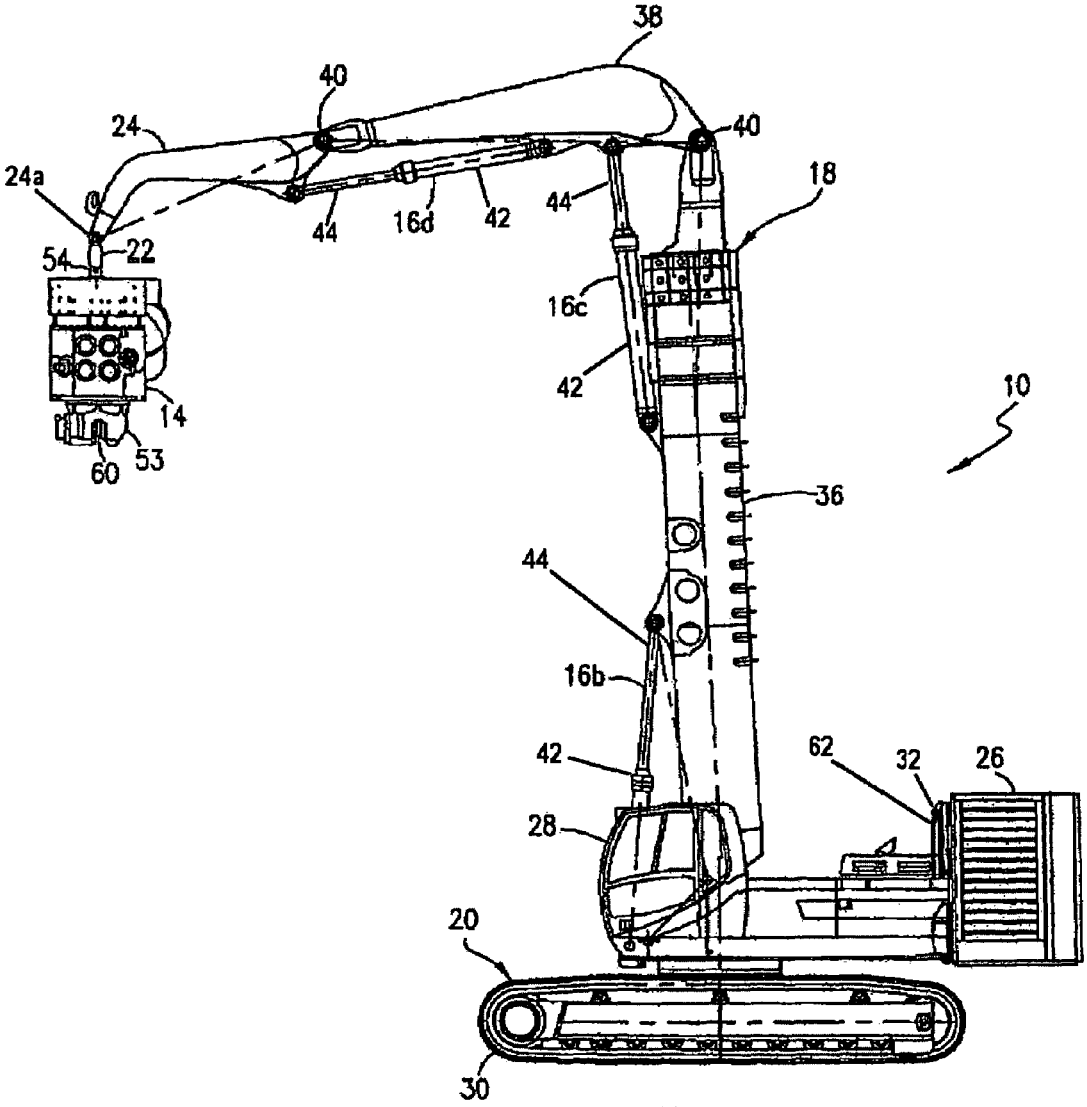
FIG. 1A shows a side elevational view of the invention with the boom in a retracted operational position without a sheet piling.

This invention relates to a sheet pile driving machine 10 exerting a strong downward or upward force to install and remove sheet piles (not pictured) using both a vibratory hammer 14 and a plurality of hydraulic double-acting cylinders 16. As illustrated in FIG. 1A, the machine 10 comprises an articulated boom 18, a large weighted base carrier 20, a connector 22 interconnected with a free hinged end 24 of said boom, and a vibratory hammer 14 for vibrating the piling simultaneously with the creation of continuous downward or upward force.

Figure 1E:
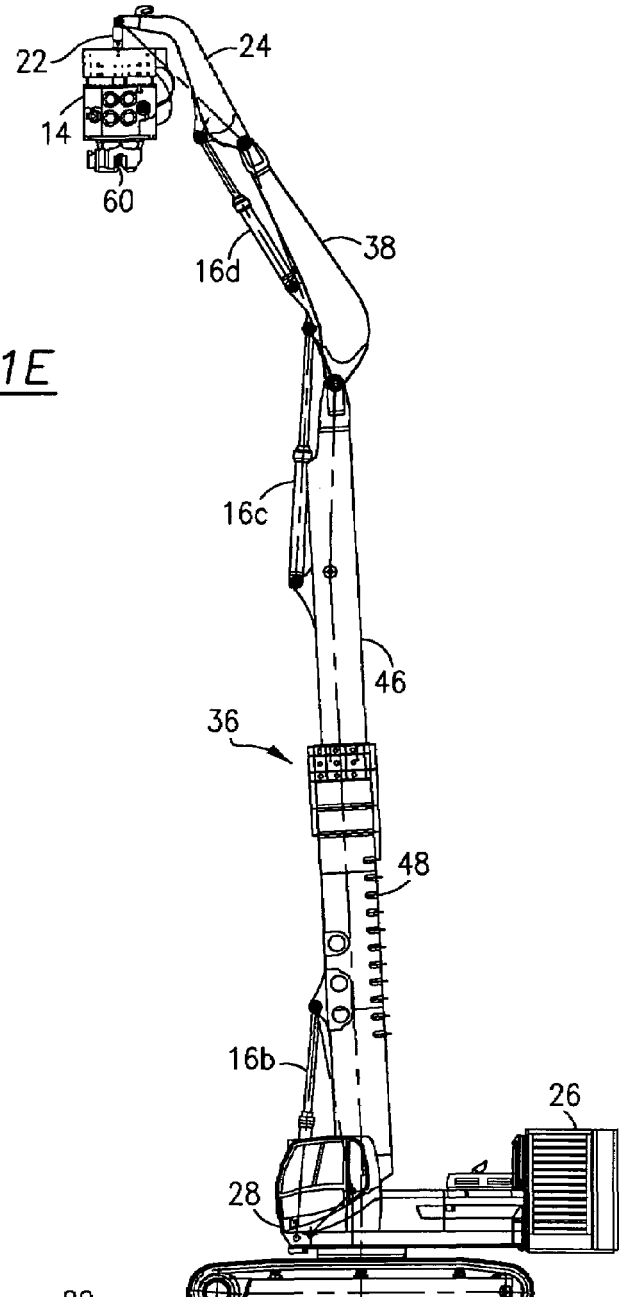
FIG. 1E shows a side elevational view of the invention with the boom extended vertically.
Figure 1B:
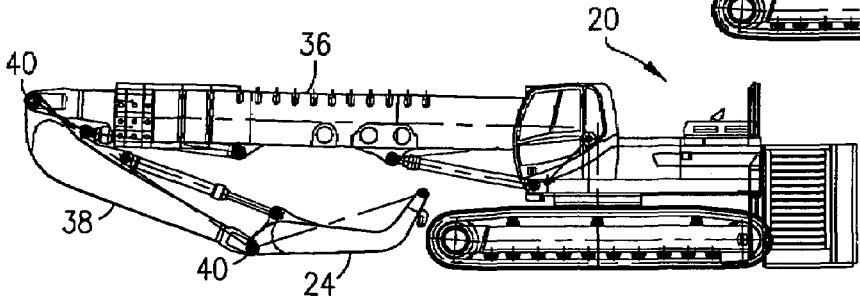
FIG. 1B shows a side elevational view of the invention with the boom collapsed and the counterweight in lowered position.
Figure 1F:
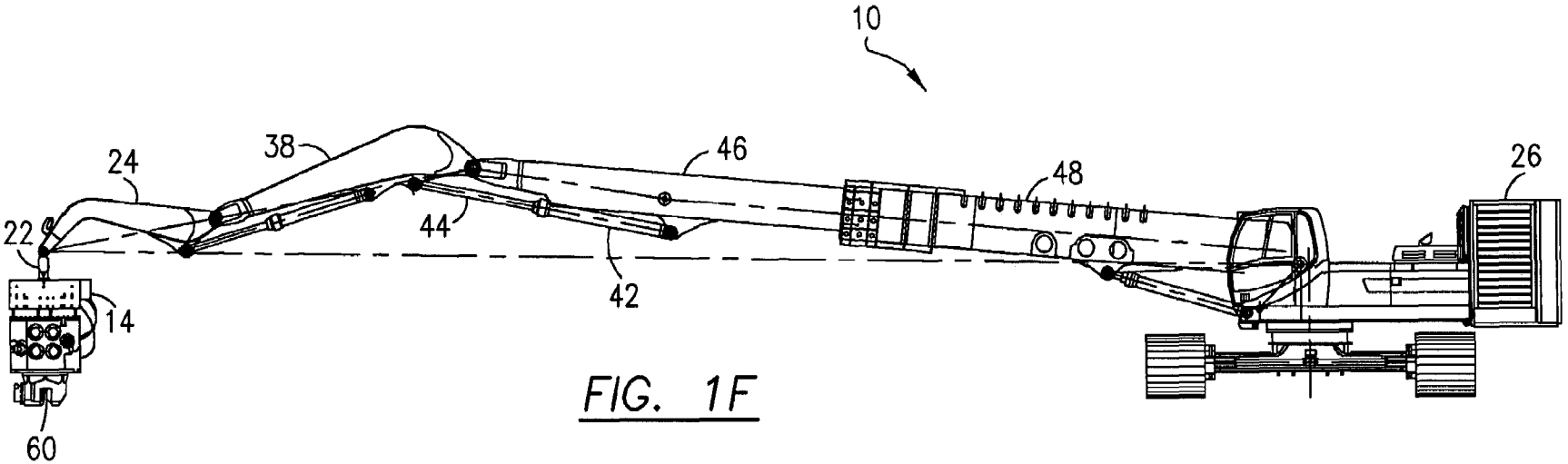
FIG. 1F shows a side elevational view of the invention with the boom fully extended horizontally.
Figure 1D:
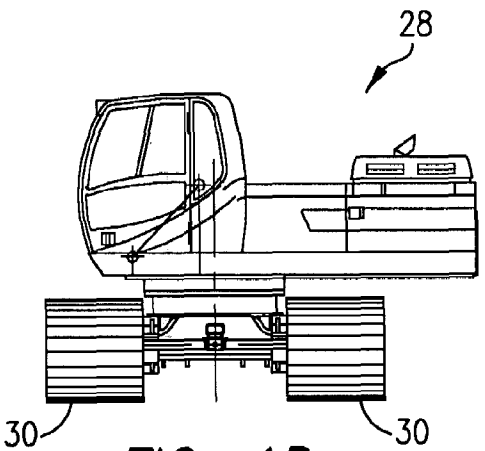
FIG. 1D shows a front elevational view of the weighted base carrier only with its tracks in extended configuration.
Figure 1C:
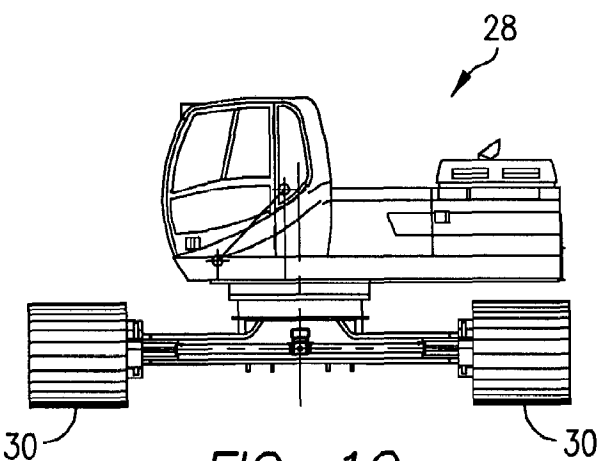
FIG. 1C shows a front elevational view of the weighted base carrier only with its tracks in retracted configuration.

The weighted base carrier 20 vertically supports the boom 18 for counterbalancing a large downward or upward, hydraulically-harnessed force from the base carrier 20 through said boom 18 to said sheet piling. The standard modified base carrier 20 is a multipurpose carrier, similar to a hydraulic excavator, which rests on the ground. Said standard base carrier 20 includes a counterweight portion 26 that can be lowered when the boom 18 is collapsed as shown in FIG. 1B and a mobile multipurpose carrier portion 28 to which the boom 18 is connected. As shown in FIGS. 1C and 1D, a left track and a right track 30 that are capable of backward and forward movement of the multipurpose carrier portion 28 of the base carrier 20 can be retracted or extended to provide additional stability to the machine 10 when it is in operation. The base carrier 20 includes a separate power pack 32 for supplying power to a plurality of hydraulic pumps (not pictured) that operate the hydraulic cylinders 16 of the pile driving machine 10. Due to the amount of force applied downward to the sheet piling, the base carrier 20 must be of sufficient weight to prevent the boom 18 and pile driving machine 10 from tipping over. In this manner, the entire base carrier 20 of the machine 10 provides a counterweight for the force applied by the hydraulic double-acting cylinders 16 mounted on and within the boom 18.

Figure 1G:
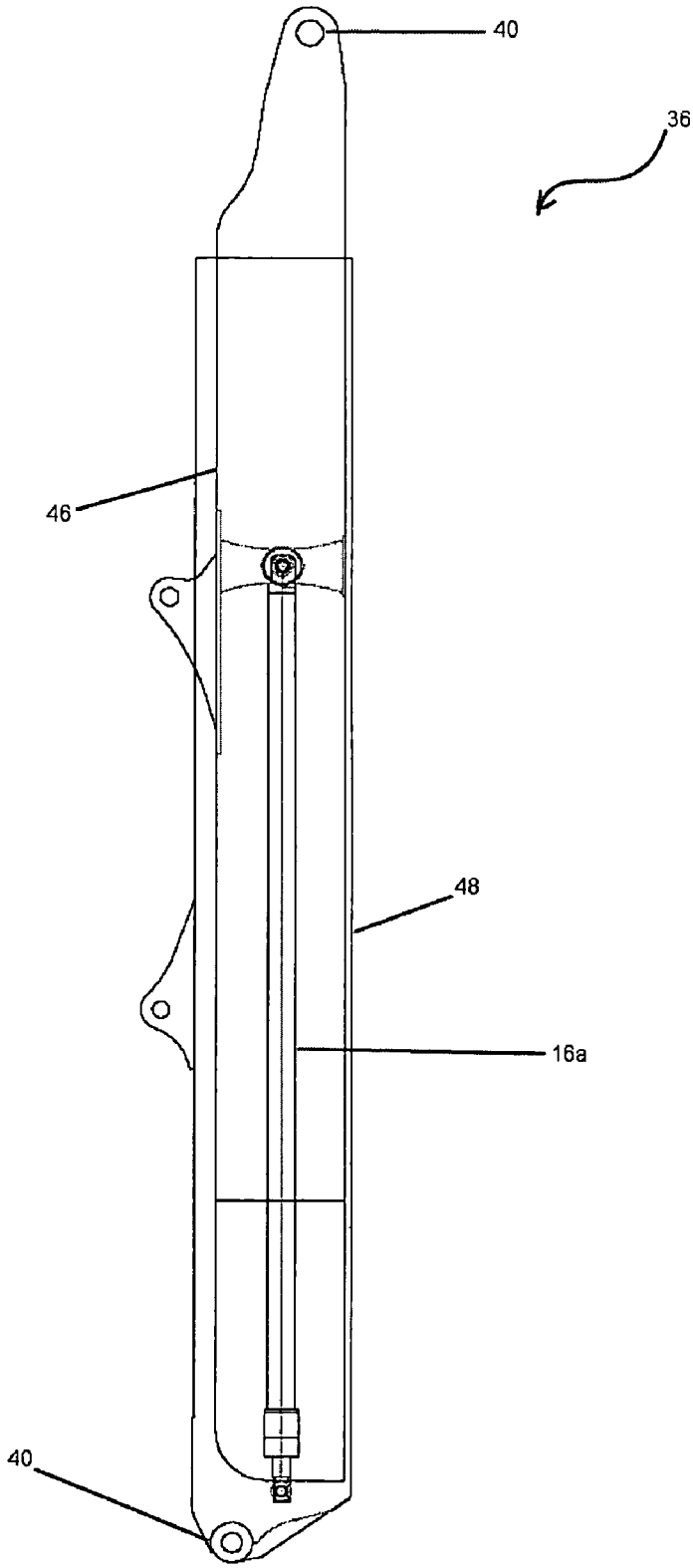
FIG. 1G shows a side cutaway view of the telescopic portion of the boom illustrating the internal hydraulic cylinder.

The novel articulated boom 18 is bi-directional, telescoping, and uses a plurality of double-acting hydraulic cylinders 16 mounted both internally and externally. The boom 18 includes a segmented telescopic portion 36, a solid middle portion 38 connected to said telescopic portion 36, and a solid free hinged end portion 24 interconnected between said middle portion 38 and the vibratory hammer 14. Each portion of the boom 18 includes a joint 40 controlled by one or more hydraulic cylinders 16 for controlling the movement of the boom, each hydraulic cylinder 16 having both a cylinder housing 42 and a piston rod 44. These hydraulic cylinders 16, which are powered by the hydraulic pumps, control the movement of each segment of the articulated boom 18, and are controlled by an operator both manually and automatically during elongation and contraction of the boom in such a way as to maintain the piling always plumb in three-dimensional planes. The operator of the apparatus is further aided in maintaining the plumbness of the driven sheet pile by a human assistant on the ground who can manually rotate said sheet pile on a horizontal axis of rotation and tilt said sheet pile until said pile is oriented at the desired angle to be driven into the ground. By operation of portions 24, 36, and 38 of the boom 18 as well as the associated hydraulic cylinders 16 and an internal hydraulic cylinder 16*a* mounted inside the telescopic portion 36 of the boom as shown in FIG. 1G, said boom can be operated at an angle from the base carrier 20 ranging from 0 to 96 degrees as illustrated in FIGS. 1E and 1F.

The telescopic portion 36 of the boom 18 includes an extendable telescopic segment 46 and a hollow receptacle segment 48 for receiving said telescopic segment when the boom is not in use. Said telescopic portion 36 and its telescopic segment 46 provide a majority of the linear reach of the articulated boom 18. The telescoping action of said telescopic portion 36 of the boom 18 is accomplished under a load by the use of hydraulics, which will be known to one skilled in the art. A plurality of hydraulic double-acting cylinders 16*b* are connected to the base carrier at their cylinder housing ends 42 and to the receptacle segment 48 of the boom's telescopic portion 36 at their piston rod ends 44 to raise said boom 18 from a horizontal to a vertical orientation. The telescoping action of the internally-mounted, hydraulic, double-acting cylinder 16*a*, shown in FIG. 1G, that operates to extend the telescopic segment 46 of the boom 18, along with the additional reach provided by the middle portion 38 and the free hinged end 24, allows the machine 10 to accommodate sheet piles up to 65 feet in length.

The middle portion 38 of the boom 18 is raised and lowered by control of a hydraulic double-acting cylinder 16*c* connected to the telescopic segment 46 of the telescopic portion 36 of the boom 18 at the cylinder housing end 42 and to the middle portion 38 of the boom at the piston rod end 44. The middle portion 38 of the boom 18 serves to aid in positioning the free hinged end 24 of said boom and the vibratory hammer 14 to extend the reach of said vibratory hammer when the boom is oriented vertically.

The free hinged end portion 24 of said boom 18 includes a pin-receiving aperture 24*a* for receiving a pin (not pictured) to engage the connector 22. The pin is inserted through the aperture 24*a* to engage said free hinged end 24 with the connector 22 of the vibratory hammer 14. To position the free hinged end portion 24 of the boom 18, the cylinder housing 42 of a hydraulic double-acting cylinder 16*d* is connected to the middle portion 38 of said boom and the piston rod end 44 of said hydraulic double-acting cylinder 16*d* is connected to said free hinged end 24 of the boom. The hydraulic double-acting cylinder 16*d* on the free hinged end 24 of said boom 18 serves to create continuous downward force on the piling. The sheet pile driving apparatus 10 includes a means for ensuring that the downward force is applied generally vertically.

The resonance-free vibratory hammer 14 vibrates the sheet piling simultaneously with the creation of continuous downward or upward forces under load by the hydraulic double-acting cylinder 16*d* attached to the boom 18 and the internal hydraulic cylinder 16*a* operating the telescopic segment 46 of the telescopic portion 36 of said boom. Said vibratory hammer 14 vibrates the driven member in a vertical direction with a high frequency at a rapid rate that is imperceptible to the human eye.

Figure 2:
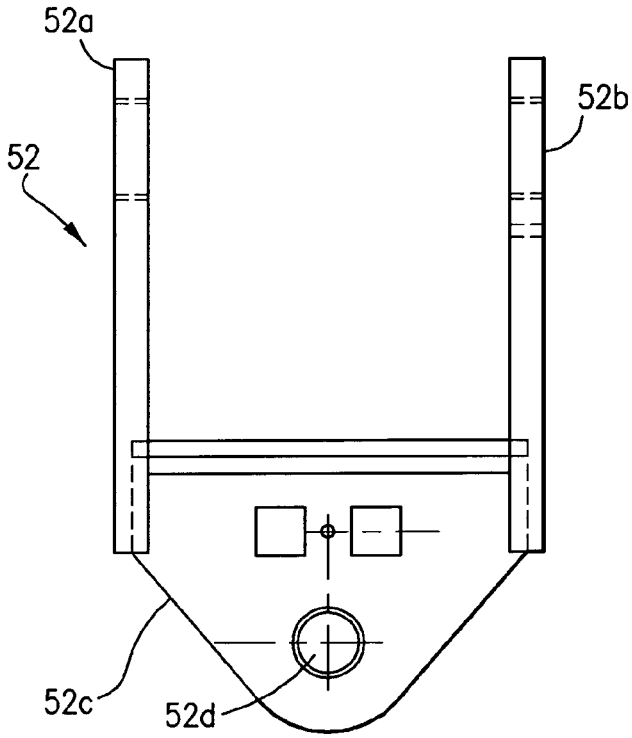
FIG. 2 is a front view of the universal joint of the connector that connects the boom to the resonance-free vibratory hammer.
Figure 3:
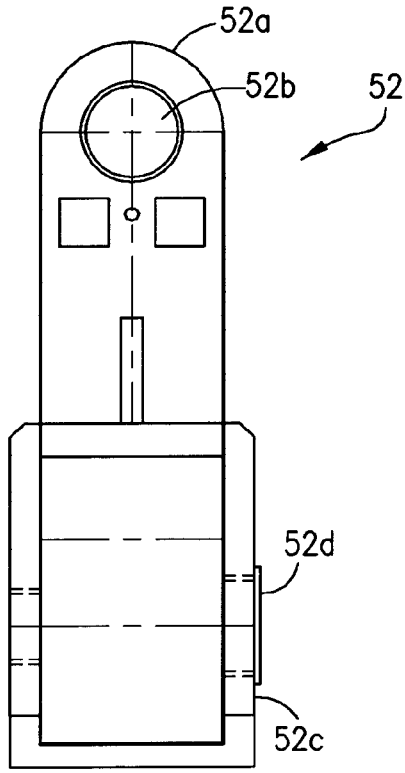
FIG. 3 is a side view of the universal joint of the connector shown in FIG. 2.
Figure 4:
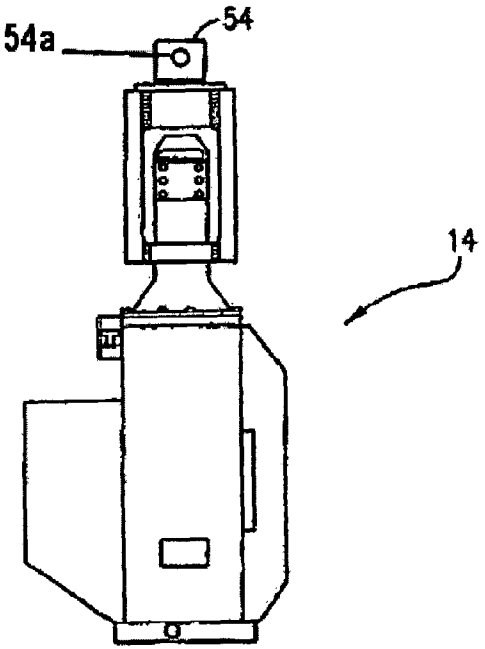
FIG. 4 shows a side view of the resonance-free vibratory hammer and swivel of the connector used with the present invention.
Figure 5:
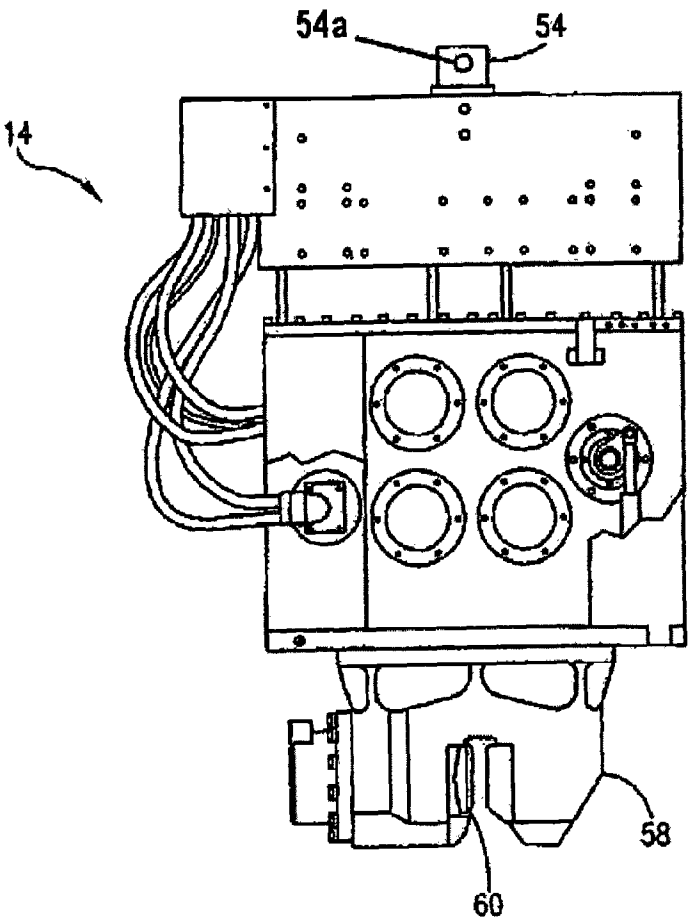
FIG. 5 shows a front view of the vibratory hammer and swivel that are illustrated in FIG. 4.

The vibratory hammer 14 includes a connector 22 that comprises a special universal joint 52 to allow movement of the vibratory hammer in a vertical plane, and a swivel 54 to allow rotational movement of the vibratory hammer in a horizontal plane. Thus, the connector 22 allows sheet piles to be driven into the earth in any direction. The special universal joint 52 of the connector 22, illustrated in FIGS. 2 and 3, comprises an upper portion 52*a* having a pin-receiving aperture 52*b* and a lower portion 52*c*, which also has a pin-receiving aperture 52*d* that is oriented perpendicularly to the channel of the aperture 52*b*. Aperture 52*b* of the special universal joint 52 is aligned with aperture 24*a* of the free hinged end 24 of the boom 18 to receive a connecting pin that interconnects said boom with the connector 22 of the vibratory hammer 14. The swivel 54 of said connector 22 includes a pin-receiving aperture 54*a* through which a rotator pin (not pictured) is inserted to engage said swivel 54 with the lower portion 52*c* of the special universal joint 52 of the connector 22. Aperture 52*d* of the special universal joint 52 is aligned with aperture 54*a* of the swivel 54, and a rotator pin is inserted through both apertures 52*d*, 54*a* to interconnect said swivel with said universal joint. In this manner, the vibratory hammer 14 is connected rigidly to the boom 18 by the connector 22 shown in FIG. 4. This rigid connection with the boom 18 prevents resonance created by the vibratory hammer 14 which would damage the boom. The swivel 54 of the connector 22 allows the vibratory hammer 14 to be articulated and rotated 360 degrees. The combination of the universal joint 52 and the swivel 54 of the connector 22 allows the operator's assistant on the ground to rotate the sheet pile being driven on a vertical axis of rotation and to angle the driven sheet piling in any direction. As illustrated in FIG. 5, the lower portion 58 of the vibratory hammer 14 includes a gripping device 60 having vise-like jaws 53 to hold firmly the sheet pile to be driven into the ground.

The vibratory hammer 14 requires special modification for use in the present invention to withstand the extreme downward and upward forces created by the hydraulic cylinders 16*b*, 16*c*, and 16*d* and the internal hydraulic cylinder 16*a* operating the telescopic segment 46 of the boom 18. This vibratory hammer 14, which will be known to one skilled in the art, is available commercially. As used in the present invention, said vibratory hammer 14 operates three to four times faster than conventional crane-suspended vibratory hammers. A separate power pack 62 incorporated inside the counterweight portion 26 of the base carrier 20 supplies a source of power for the vibratory hammer 14 independent of the power pack 32 used to supply power to the base carrier 20. Alternatively, the power pack 32 used to supply power to the base carrier 20 may also be adapted to supply power to the vibratory hammer 14.

The machine 10 is used in a method of driving a sheet piling that allows automatic continuous force for preloading or extraction of the sheet piles, and which is two to three times faster than traditional vibratory pile driving. The elongated bi-directional, hydraulic telescoping boom 18 creates a controlled downward or upward vertical force through the action of the internal hydraulic cylinder 16*a*, which is mounted inside the receptacle segment 48 to operate the telescopic segment 46 of said boom (see FIG. 1G), and/or by the hydraulic double-acting cylinders 16*b*, 16*c*, and 16*d*, which in their downward thrust drive the sheet pile into the ground. The downward or upward force exerted by the machine 10 through the boom 18 and its three portions 24, 36, and 38 is variable from 1 to 30 tons. The connector 22 at the free hinged end 24 of said boom 18 connects the boom to the sheet pile through a resonance-free vibratory hammer 14, which engages the sheet pile to be installed or removed through a gripping device 60. The hydraulic piston 16*d* interconnected with the free end 24 of the boom 18 applies a continuous downward (in the case of sheet pile installation) or upward (in the case of sheet pile removal) force from the boom onto the sheet piling. As the hydraulic piston 16*d* exerts the downward or upward force on said sheet pile, the vibratory hammer 14 simultaneously vibrates said sheet piling in a vertical motion to drive the sheet piling into soil under the sheet piling, or in the case of sheet pile removal, forcefully extracts said sheet piling from the ground.

The vibratory hammer 14 can be connected to steel piling and casing piling in addition to sheet piling.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method of driving a sheet piling that allows continuous force for preloading or extraction of the piling during installation comprising the steps of:

providing an elongated bi-directional, hydraulic telescoping boom that creates a controlled downward or upward vertical force, the boom comprising:

a) a telescopic lower portion, including a plurality of hydraulic double-acting cylinders for raising the boom from a horizontal to a vertical orientation and an internal hydraulic cylinder for extending and retracting a telescopic segment from a receptacle segment to accommodate differing lengths of sheet piling;

b) a middle portion pivotally connected to the telescopic lower portion, the middle portion including a hydraulic double-acting cylinder providing control over the positioning of a modified resonance-free vibratory hammer and providing additional reach to the boom; and c) a free hinged portion having a first end pivotally connected to the middle portion, the free hinged portion being actuated by a hydraulic double-acting cylinder creating the downward or upward force to drive sheet piles;

providing a weighted base carrier that vertically supports the boom for counterbalancing a downward or upward, hydraulically-harnessed force from the base carrier through said boom to said sheet piling;

providing an articulated connector at a second end of the free hinged portion for connecting the boom to the sheet piling through the modified resonance-free vibratory hammer;

connecting the resonance-free vibratory hammer to the sheet piling to be installed or removed;

applying a continuous downward or upward force from the boom on the sheet piling; and simultaneously vibrating the sheet piling to drive the sheet piling into soil under the sheet piling, or to forcefully extract the sheet piling from the ground.

2. The method of claim 1, wherein the connector to the vibratory hammer comprises a swivel to provide rotational movement in a horizontal plane and a universal joint that connects to the free hinged end of the boom to provide movement in a vertical plane to the vibratory hammer.

3. The method of claim 1, wherein the free hinged portion comprises an inwardly curved arm.

4. The method of claim 1, wherein the telescopic segment of the boom extends to a length that allows for the driving or extraction of a sheet pile having a length of approximately 65 feet.

5. A machine comprising:

a) an elongated bi-directional, hydraulic telescoping boom for creating a controlled downward or upward vertical force, said boom comprising a telescopic portion, including a plurality of hydraulic double-acting cylinders for moving the boom between a horizontal and a vertical orientation and an internal mounted hydraulic cylinder for extending and retracting a telescopic segment from a receptacle segment, a middle portion pivotally connected to the telescopic portion, a hydraulic double-acting cylinder connecting the telescopic portion to the middle portion to actuate the middle portion and to provide additional reach to the boom, and a free hinged portion pivotally connected to the middle portion, the free hinged portion comprising an inwardly curved arm, and a hydraulic double-acting cylinder connecting the middle portion to the free hinged portion to actuate the free hinged portion;

b) a weighted base carrier that vertically supports the boom for counterbalancing a downward or upward, hydraulically-harnessed force from the base carrier through the boom to the free hinged portion; and c) an articulated connector connecting the free hinged portion of the boom to a resonance-free vibratory hammer.

6. The machine of claim 5, wherein the connector comprises a swivel, and the swivel includes a pin-receiving connection aperture.

7. The machine of claim 6, wherein the connector further comprises a universal joint, the universal joint having an upper portion having a pin-receiving connection aperture that is aligned with a pin-receiving aperture of the free hinged portion of the boom, a connecting pin connecting said free hinged end with the vibratory hammer; and a lower portion having a pin-receiving connection aperture that is aligned with a pin-receiving connection aperture of the swivel to receive a connection pin inserted into the aligned apertures to engage said swivel with a lower portion of the universal joint.

8. The machine of claim 5, wherein the connector connecting the vibratory hammer to the boom comprises a swivel to allow said vibratory hammer and the sheet pile being driven to be rotated 360 degrees and a universal joint to allow movement of the vibratory hammer and sheet pile in a vertical plane.

9. The machine of claim 5, wherein the boom is articulated and can telescope in and out with a load that varies depending on the type and/or resistance of the soil into which a sheet pile is being driven and the length of said piling.

10. The machine of claim 5, wherein the boom is configured to operate at an angle from the base carrier ranging from 0 to 96 degrees to drive sheet piles up to 65 feet long into the earth.

11. The machine of claim 5, wherein the base provides a counterweight for the force applied by the boom.

12. A sheet pile driving machine providing continuous preloading of a sheet piling during installation or removal, comprising:

an articulated boom comprising:

a) a telescopic portion, including an extendable telescopic segment and a hollow receptacle segment for receiving said telescopic segment when the boom is not in use, said telescopic portion and its telescopic segment providing up to sixty-five feet of the linear reach of the articulated boom with the telescoping action of said telescopic portion operable by a plurality of telescopic portion hydraulic double-acting cylinders wherein each cylinder has a housing end and a piston rod end and each cylinder is connected to a base carrier at the housing end and to the receptacle segment of the telescopic portion of the boom at the piston rod end;

b) an internal hydraulic, double-acting cylinder that operates under load to retract and extend the telescopic segment into and out of the receptacle segment of the boom, said internal hydraulic cylinder being mounted inside the receptacle segment of the telescopic portion of said boom;

c) a middle portion extendable by operation of a middle portion hydraulic double-acting cylinder having a cylinder housing end connected to the telescopic segment of the telescopic portion of the boom and a piston rod end connected to said middle portion of the boom;

d) a free hinged end portion; and e) a hydraulic double-acting cylinder with a cylinder housing end connected to the middle portion of said boom and a piston rod end connected to said free hinged end portion of the boom;

a large weighted base vertically supporting the boom including a counterweight portion;

a connector comprising a swivel engaged with the free hinged end of the boom for interconnecting said boom to the piling; and a vibratory hammer engaged with the swivel of said connector.

* * * * *